US009796553B2

(12) United States Patent
Balsells et al.

(10) Patent No.: US 9,796,553 B2
(45) Date of Patent: Oct. 24, 2017

(54) SYSTEM FOR HOLDING SHEET MATERIAL FOR PLOTTERS

(75) Inventors: Antoni Balsells, Key Biscayne, FL (US); Francesc Masgrau Lagresa, Girona (ES); Antoni Guimera Pedrola, Barcelona (ES)

(73) Assignee: TKT BRAINPOWER S.L., Barcelona (ES)

( * ) Notice: Subject to any disclaimer, the term of this patent is extended or adjusted under 35 U.S.C. 154(b) by 424 days.

(21) Appl. No.: 13/577,563

(22) PCT Filed: Feb. 8, 2011

(86) PCT No.: PCT/ES2011/070084

§ 371 (c)(1),
(2), (4) Date: Sep. 20, 2012

(87) PCT Pub. No.: WO2011/098648

PCT Pub. Date: Aug. 18, 2011

(65) Prior Publication Data

US 2013/0001352 A1 Jan. 3, 2013

(30) Foreign Application Priority Data

Feb. 10, 2010 (ES) ..... 201030179

(51) Int. Cl.
*B41J 15/04* (2006.01)
*B65H 19/22* (2006.01)
(Continued)

(52) U.S. Cl.
CPC ..... *B65H 19/2276* (2013.01); *B65H 19/28* (2013.01); *B65H 75/185* (2013.01);
(Continued)

(58) Field of Classification Search
CPC ..... B65H 16/02; B65H 16/04; B65H 16/06; B65H 75/185; B65H 75/28; B65H 2801/36; B41J 15/04; B41J 15/02
(Continued)

(56) References Cited

U.S. PATENT DOCUMENTS 1,935,367 A * 11/1933 Bebie et al. ..... 242/613.5
1,941,495 A * 1/1934 Schoultheis ..... 242/573.3
(Continued)

FOREIGN PATENT DOCUMENTS

JP 60-077074 A 5/1985
JP 11-139633 A 5/1999
(Continued)

OTHER PUBLICATIONS

International Search Report issued by the International Searching Authority (ISA/O.E.P.M.) on Jun. 14, 2011 in connection with International Application No. PCT/ES2011/070084.

*Primary Examiner* — William A Rivera
(74) *Attorney, Agent, or Firm* — Gary J. Gershik; Cooper & Dunham LLP

(57) ABSTRACT

The present invention relates to a holding system for holding sheet material for plotters characterized in that it comprises at least one substantially tubular side holding element (1), at least part of the external surface (2) thereof being tapered. Furthermore, said side holding element (1) comprises a longitudinal opening (7) and has internal chamfers at one of its ends (4). As a result of the thickness and the tapering of the external surface thereof, the side holding element hold the sheet material and, simultaneously, ensures that there is a gap between the winder tube and the sheet material wound on said tube, which facilitates its removal from the tube.

12 Claims, 2 Drawing Sheets

(51) Int. Cl.

| | |
|---|---|
| ***B65H 75/18*** | (2006.01) |
| ***B65H 19/28*** | (2006.01) |
| ***B65H 75/22*** | (2006.01) |
| ***B65H 75/28*** | (2006.01) |

(52) U.S. Cl.
CPC ..... *B65H 75/22* (2013.01); *B65H 75/28* (2013.01); *B65H 2301/41427* (2013.01); *B65H 2801/36* (2013.01)

(58) Field of Classification Search
USPC ..... 242/597, 597.5, 597.6, 599, 599.4, 596, 242/596.7
See application file for complete search history.

(56) References Cited

U.S. PATENT DOCUMENTS

| | | | | | |
|---|---|---|---|---|---|
| 3,145,451 | A * | 8/1964 | Christensen | 492/21 |
| 3,615,063 | A * | 10/1971 | Bates | 242/613.5 |
| 3,722,929 | A | 3/1973 | Gilman | |
| 3,837,591 | A * | 9/1974 | Clarke | 242/573.4 |
| 4,327,874 | A * | 5/1982 | Bruno | 242/571.5 |
| 5,267,704 | A * | 12/1993 | Kitamura et al. | 242/570 |
| 5,683,058 | A * | 11/1997 | Schwarz et al. | 242/578.2 |
| 5,791,585 | A * | 8/1998 | Knight et al. | 242/434.7 |
| 5,813,343 | A * | 9/1998 | Harb | 101/407.1 |
| 6,109,801 | A * | 8/2000 | Mabit | B65H 75/18 400/242 |
| 6,183,153 | B1 * | 2/2001 | Kamoda et al. | 400/613 |
| 6,491,252 | B2 * | 12/2002 | Komatsu et al. | 242/596.1 |
| 6,503,008 | B2 * | 1/2003 | Zevin et al. | 400/613 |
| 6,726,144 | B2 * | 4/2004 | Squires | 242/597.6 |
| 6,877,920 | B2 * | 4/2005 | Fujioka | 400/613 |
| 6,997,629 | B2 * | 2/2006 | Bungert et al. | 400/613 |
| 7,128,291 | B1 * | 10/2006 | Schanke et al. | 242/533.7 |
| 7,168,650 | B2 * | 1/2007 | Inana et al. | 242/348 |
| 7,191,979 | B2 * | 3/2007 | Paukov | 242/578.2 |
| 7,537,180 | B2 * | 5/2009 | Morand | 242/596.7 |
| 2001/0042810 | A1 | 11/2001 | Christensen | |
| 2006/0266873 | A1 * | 11/2006 | Friesen et al. | 242/596.7 |
| 2007/0059081 | A1 * | 3/2007 | Silverbrook | B41J 15/02 400/614 |
| 2007/0063092 | A1 * | 3/2007 | Zevin et al. | 242/571.5 |
| 2009/0283623 | A1 * | 11/2009 | Yamada | 242/596.7 |
| 2015/0328906 | A1 * | 11/2015 | Sumioka | B41J 11/04 242/564.5 |

FOREIGN PATENT DOCUMENTS

| | | | |
|---|---|---|---|
| JP | 2003-211762 | A | 7/2002 |
| JP | 2004-243727 | A | 9/2004 |
| JP | 2004-276243 | A | 10/2004 |
| JP | 2008-018661 | A | 1/2008 |
| JP | 2009-203029 | A | 9/2009 |
| WO | WO 97/20695 | | 6/1997 |

* cited by examiner

SYSTEM FOR HOLDING SHEET MATERIAL FOR PLOTTERS

RELATED APPLICATIONS

This application is a §371 national stage of PCT International Application No. PCT/ES2011/070084, filed Feb. 8, 2011, claiming priority of Spanish Patent Application P201030179, filed Feb. 10, 2010, the contents of each of which are hereby incorporated by reference into this application.

The present invention relates to a holding system for holding sheet material for plotters, specifically for holding the sheet material onto the winder tube of a plotter.

BACKGROUND OF THE INVENTION

Plotters comprise a winder tube on which there is wound the sheet material where a drawing or an image is plotted.

For the correct winding of the sheet material, it is necessary to hold the leading end of said sheet material onto said winder tube.

Today no holding system specifically made for this application is known, rather any conventional holding means, such as adhesive tape, for example, is commonly used.

The use of adhesive tape has the drawback that it complicates the removal of the sheet material from the winder tube once the plotting operation has ended due to two main reasons:

First, it is necessary to peel the adhesive tape off the winder tube, which is not simple since there may be several layers of sheet material on said adhesive tape.

Furthermore, there is no gap between the winder tube and the sheet material and, if the reel of sheet material is very thick, the pressure between said winder tube and the sheet material may be high, making the removal of the reel of sheet material from the winder tube difficult.

Therefore, there is an obvious need for a holding system for holding sheet material especially designed for use with plotters, which allows an easy holding and removal of the sheet material.

DESCRIPTION OF THE INVENTION

The holding system of the invention successfully solves the mentioned drawbacks, having other advantages which will be described below.

The holding system for holding sheet material for plotters of the present invention is characterized in that it comprises at least one substantially tubular side holding element, at least part of its external surface being tapered.

As a result of the thickness and the tapering of the external surface thereof, the side holding element holds the sheet material and, simultaneously, ensures that there is a gap between the winder tube and the sheet material wound onto said tube, which facilitates its removal from the tube.

The tapering feature of the side holding element facilitates removing from same the reel of sheet material held by the side holding element.

This side holding element also allows winding the sheet material clockwise and to the anti-clockwise.

Advantageously, said side holding element comprises a longitudinal opening, which allows placing the side holding element on the tube.

To facilitate the entry of the sheet material, said side holding element preferably has an internal chamfer at one of its ends.

Said side holding element preferably comprises a gripping area, facilitating the removal of the side holding element from the reel of sheet material and also from the winder tube.

The holding system of the present invention can also comprise at least one central holding element, if the width of the sheet material to be wound so require, for holding the sheet material and assuring that the sheet material is not incorrectly folded when starting the winding.

Said central holding element has a small thickness, such that it fits into the free space left between the winder tube and the reel of sheet material. Therefore, the removal of the sheet material from said winder tube is not hindered.

According to a preferred embodiment, said central holding element is formed by a curved body and comprises an internal holding area for holding the sheet material.

This internal holding area prevents the sheet material from escaping, allows the movement of the sheet material in the direction of the tube, i.e., it does not resist the removal of the tube or of the sheet material, containing the central holding element inside the reel.

Furthermore, said central holding element is symmetrical such that it can hold sheet material to be wound clockwise and also anti-clockwise.

The central holding element has a reduced height, such that it fits perfectly into the space left between the interior of the reel of sheet material and the winder tube, not blocking the exit of the tube from inside the reel.

BRIEF DESCRIPTION OF THE DRAWINGS

To better understand the foregoing, several drawings are attached in which a practical case of embodiment is schematically depicted only by way of non-limiting example.

DESCRIPTION OF A PREFERRED EMBODIMENT

First, it must be indicated that the holding system for holding sheet material of the present invention is especially ideal for use in a plotter, even though it could be used in any suitable machine in which the sheet material is wound onto a tube.

Figure 1:
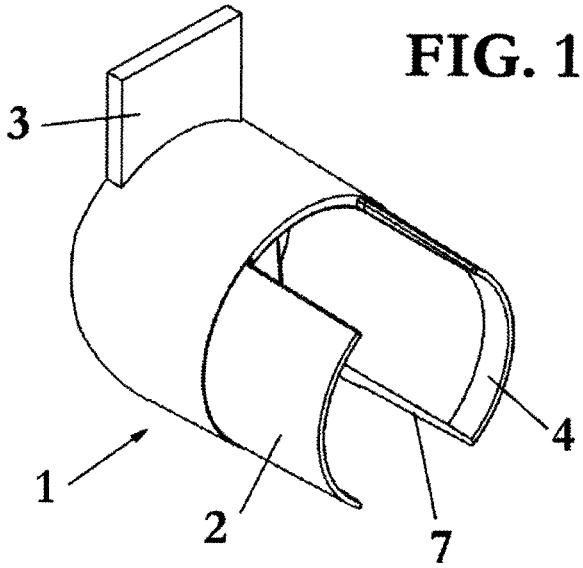
FIG. 1 is a perspective view of a side holding element according to the present invention.
Figure 2:
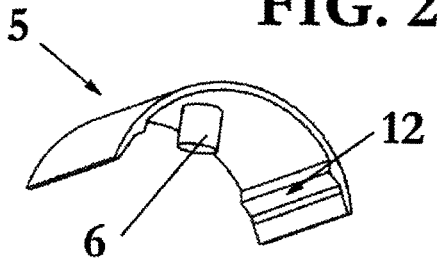
FIG. 2 is a perspective view of a central holding element according to the present invention.
Figure 3:
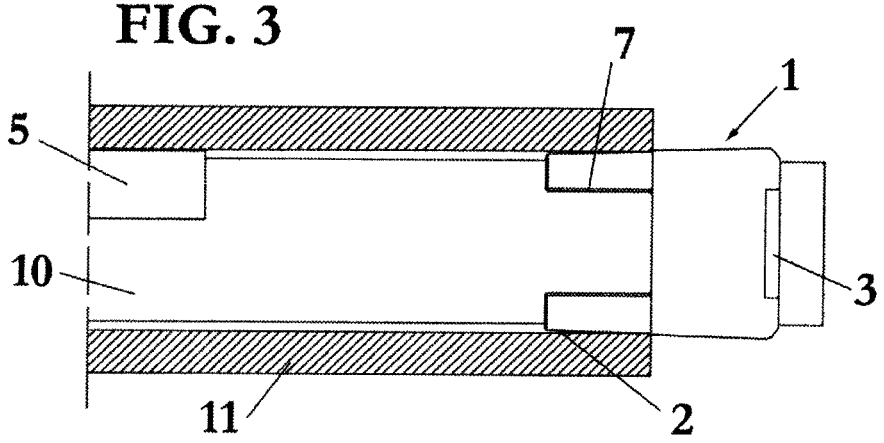
FIG. 3 is a cross-section view of a winder tube provided with the holding system of the present invention, a reel of sheet material being placed on the tube.

According to the invention, the holding system comprises at least one side holding element, preferably two, located at one or both ends of a winder tube 10 (FIG. 3).

The side holding element, generally indicated by means of reference number 1, is formed from a substantially tubular body, defining an inner diameter equivalent to the diameter of the winder tube 10 on which it will be placed.

As can be better seen in FIG. 3, at least part of the external surface 2 of said side holding element 1 has a slight tapering.

The side holding element 1 also comprises a gripping area 3, preferably placed perpendicular with respect to the longitudinal axis of the side holding element 1. This gripping area 3 facilitates the removal of the side holding element 1 from the reel of sheet material and also from the winder tube 10, as will be indicated below.

To facilitate the side entry of the side holding element 1 into the winder tube 10 and particularly to facilitate the side entry into the sheet material without wrinkling or deforming same, said holding element 1 has an internal chamfer at one of its ends 4.

To facilitate the vertical entry of the side holding element 1, the latter comprises a longitudinal opening 7.

If the length of the winder tube 10 so requires, the holding system of the present invention can also comprise one or more central holding elements 5. Said central holding element 5 is formed from a curved body provided with a protrusion 6 in its internal part, which is housed in its assembly position inside a hole (not depicted) provided in said winder tube 10.

Said central holding element 5 also comprises a holding area 12, which, as indicated previously, prevents the sheet material from escaping, allows the movement of the sheet material in the direction of the tube, i.e., it does not resists the removal of the tube or of the sheet material, containing the central holding element inside the reel.

When the sheet material is to be held onto the winder tube 10, a side holding element 1 must simply be placed vertically or laterally on said tube 10 in an area free from the sheet material. Then, by sliding the holding element 1 on the tube 10, the sheet material is located between the tube and the holding element 1, such that the sheet material will be gradually wound on the frusto-conical external surface 2 of the holding element 1. A side holding element 1 can also be placed vertically directly on the sheet material which is in turn on the tube 10.

This operation is preferably performed in the same manner at the other end of the winder tube 10.

If the presence of a central holding element 5 is necessary, it will be placed before said holding operation of the side holding element 1.

When the entire sheet material 11 has been wound onto the winder tube 10 (FIG. 3) and said sheet material 11 is to be removed, first, one of the side holding elements 1 is removed, sliding it towards the free end of the winder tube 10. This sliding will be facilitated by the presence of the gripping area 3.

The sheet material 11 will then be removed by also sliding it along said free end, which is already without the side holding element 1.

This removal will be very easy, since the sheet material 11 will be separated from the winder tube 10 or, in any case, the pressure which will be exerted by said sheet material 11 on said tube 10 will be much less than in the case where the entire sheet material 11 has been wound directly onto the tube 10.

Despite that reference has been made to a specific embodiment of the invention, it is obvious for a person skilled in the art that the holding system described is susceptible to various variations and modifications, and that all the details mentioned can be substituted with other technically equivalent details without departing from the scope of protection defined by the claims attached.

The invention claimed is:

1. A holding system for holding sheet material for plotters, comprising a winder tube having an external diameter; and at least one substantially tubular side holding element having an inner diameter and an external surface that has a tapered external surface portion, the tapered external surface portion having at least one longitudinal opening, wherein the inner diameter of the side holding element is substantially equivalent to the external diameter of the winder tube such that the side holding element can fit on the winder tube, and wherein the at least one longitudinal opening allows sheet material to pass through such that the sheet material is (i) located between winder tube and side holding element, (ii) wound only on the tapered external surface portion of the side holding element, and (iii) wound such that a gap exists between the sheet material and the winder tube.

2. The holding system according to claim 1, wherein said side holding element has an internal chamfer at one of its ends.

3. The holding system according to claim 2, wherein said side holding element comprises a gripping area.

4. The holding system according to claim 1, wherein said side holding element comprises a gripping area.

5. The holding system according to claim 1, which also comprises at least one central holding element.

6. The holding system according to claim 5, wherein said central holding element is formed by a curved body.

7. The holding system according to claim 6, wherein said central holding element comprises an internal holding area.

8. The holding system according to claim 7, wherein the central holding element is symmetrical across its central axis.

9. The holding system according to claim 6, wherein the central holding element is symmetrical across its central axis.

10. The holding system according to claim 5, wherein said central holding element comprises an internal holding area.

11. The holding system according to claim 10, wherein the central holding element is symmetrical across its central axis.

12. The holding system according to claim 5, wherein the central holding element is symmetrical.

* * * * *